US005460160A

United States Patent [19]

Parrott

[11] Patent Number: 5,460,160

[45] Date of Patent: Oct. 24, 1995

[54] PORTABLE GOLF BALL WARMING DEVICE

[76] Inventor: William T. Parrott, 6411 View St., NE., Tacoma, Wash. 98003

[21] Appl. No.: 315,070

[22] Filed: Sep. 29, 1994

[51] Int. Cl.[6] ..... F24J 1/00

[52] U.S. Cl. ..... 126/263.01

[58] Field of Search ..... 126/263 R, 263 A, 126/263 D, 263 DA, 263 DB, 263 DC, 263 DD

[56] References Cited

U.S. PATENT DOCUMENTS

| | | | |
|---|---|---|---|
| 2,272,340 | 2/1942 | Hampton | 126/263 D |
| 3,683,155 | 8/1972 | Loofbourow . | |
| 3,806,701 | 4/1974 | Scott . | |
| 3,828,165 | 8/1974 | Collins . | |
| 3,831,001 | 8/1974 | Toomey et al. . | |
| 4,155,002 | 5/1979 | Cohen . | |
| 4,545,362 | 10/1985 | Hendricks | 126/263 A |
| 4,967,062 | 10/1990 | Cohen . | |
| 5,057,670 | 10/1991 | Cohen . | |

*Primary Examiner*—Carroll B. Dority
*Attorney, Agent, or Firm*—Jeffrey J. King

[57] ABSTRACT

A portable golf ball warming device comprising a hollow container having separate loading and dispensing apertures and a warming reservoir, which collectively define a staged warming pathway. The warming device has a fully self-contained warming element which uses a non-rechargeable, chemical heating composite to continuously, serially warm golf balls during extended cold-weather play.

3 Claims, 3 Drawing Sheets

PORTABLE GOLF BALL WARMING DEVICE

TECHNICAL FIELD

The invention relates to warming devices for warming golf balls. More specifically, the invention relates to portable warming devices for warming golf balls to improve ball performance for cold weather play.

BACKGROUND OF THE INVENTION

It is generally known that golf balls exhibit diminished performance under cold temperature playing conditions. It is also known that ball performance can be improved for cold weather play by artificially warming the balls to a temperature of about 90° to 120° F.

Golfers have previously attempted to artificially improve cold weather ball performance by warming the balls in a low temperature oven, by soaking them in hot water, by storing them in a pocket or other warm location, and by a variety of other rudimentary techniques. However, such improvisational methods are generally inconvenient, inefficient and unpredictable in their results.

Consequently, numerous devices have been developed for artificially warming golf balls to improve their performance for cold weather golf play. Almost all of these devices utilize a non self-contained, electrical resistance heating element coupled to an insulated warming chamber to warm the balls before a round of golf play commences. For example, U.S. Pat. Nos. 4,155,002, 4,967,062 and 5,057,670, issued to Cohen each disclose an elongated container having a cylindrical, insulated ball warming chamber and an electrical resistance heating element enclosed within the container or warming chamber for warming the balls. To operate these devices, the heating element is plugged into an electrical outlet in a home or locker room for several hours before the round of golf play commences, whereby the balls become warmed to a higher performance temperature. Once the balls have been warmed, the devices are unplugged and taken onto the golf course, whereafter the warmed balls are removed for play and no further heating occurs. Similar electrical resistance warming devices are described in U.S. Pat. No. 3,683,155, issued to Loofbourow, and in U.S. Pat. No. 3,831,001, issued to Toomey.

A principal drawback of golf ball heating devices which rely on electrical resistance heating elements is that such devices are not self-contained, and therefore do not provide for true portability of use. Even though the devices can be disconnected from the electrical outlet to allow them to be carried onto a golf course, they do not allow for continued heating of balls during a round of play. Thus, although the above devices typically provide an insulated warming chamber, the pre-heated balls begin to cool off soon after the warming devices are disconnected. Moreover, due to space and weight limitations only a limited number of golf balls can be pre-heated before a round of play. Therefore, the available supply of pre-heated balls can easily be exhausted before an extended round of play ends.

At least one prior art device attempts to overcome the problems of limited capacity and cooling which attend the use of electrical resistance golf ball warming devices. In particular, the warming device described in U.S. Pat. No. 3,828,165, issued to Collins, relies on the motive system of a golf cart to heat golf balls housed in cylindrical tubes thermally connected to the motive system. With the Collins device, balls may be continuously warmed during a round of play, and the capacity of the warming tubes is not limited by the portability considerations which attend the use of manually transported devices. However, the Collins device does not address the needs of the majority of golfers who do not use motorized golf carts, and must therefore depend on portable ball warming devices.

Only one golf ball warming device yet developed can be characterized as semi-portable, in that it offers a partially self-contained heating design. U.S. Pat. No. 3,683,155, issued to Loofbourow, shows a golf ball warming device employing a pocket warmer type, liquid fuel heating source. The Loofbourow device includes a pie-shaped container enclosing a circular trough which holds a number of golf balls to be heated, and a combustible, liquid fuel heat source underlying the trough for heating the trough and warming the balls held therein.

Although the Loofbourow device may be characterized as partially self-contained and semi-portable, its usefulness for extended, cold weather golf play is limited. Whereas the device may allow for some continued heating of balls during play, it is generally intended for prolonged pre-warming of balls before a round of play commences. The heat source of the Loofbourow device is a manually ignited, liquid fuel-soaked heating pad, which is non-disposable and must be recharged prior to each use. Recharging the pad is generally time consuming and messy, and may involve hazardous exposure of the user to caustic, flammable fuel. This lack of full self-containment makes the device poorly suited for continued warming of golf balls during an extended round of play, because recharging the pad during play is generally undesireable.

Moreover, the Loofbourow device is designed to provide only a single warming treatment of golf balls loaded into the device in one, bulk transfer. Accordingly, all of the balls are heated together until play begins, after which time the balls are removed individually while play continues, until the stock of prewarmed balls is exhausted. Consequently, in view of the space and weight limitations inherent in portable golf ball warming devices, the exhaustion of warmed balls can readily occur before an extended round of play ends.

In view of the above, a need exists in the golfing industry for a golf ball warming device which is portable and self-contained and which provides for continuous warming of golf balls during an extended round of cold weather golf play.

An additional need exists for a portable golf ball warming device which provides a sufficient supply of warmed golf balls throughout an extended round of cold weather golf play, without relying on extensive pre-heating or a heavily insulated design.

A further need exists for a golf ball warming device which utilizes a self-contained heat source that obviates the hazards and inconveniences of manually ignited, rechargeable, liquid fuel heating pads.

SUMMARY OF THE INVENTION

It is therefore an object of the invention to provide a golf ball warming device which is portable and self-contained and which continuously warms golf balls during an extended round of cold weather golf play.

It is an additional object of the invention to provide a golf ball warming device which generates a sufficient supply of warmed golf balls throughout an extended round of cold weather golf play, but which does not require extensive pre-heating periods before play begins, or rely on a heavily insulated design.

It is a further object of the invention to provide a golf ball warming device which utilizes a self-contained heat source adapted to overcome the hazards and inconveniences of combustible, non-disposable, liquid fuel heating pads.

The invention achieves these objects and other objects and advantages which will become apparent from the description which follows, by providing a portable, self-contained golf ball warming device for continuously warming and rewarming balls during an extended round of cold weather play. The device includes a hollow container having a warming reservoir inside the container for receiving a number of unwarmed golf balls. The container has a loading aperture for loading the unwarmed balls into the reservoir, and a separate, dispensing aperture for dispensing balls from the reservoir after they have been warmed therein. The apertures and reservoir collectively define a staged warming pathway through which the golf balls are serially passed to become stagedly warmed. To heat the staged warming pathway, the invention provides a fully self-contained warming mechanism proximate the warming reservoir which effectively transmits heat thereto.

In a preferred embodiment of the invention, the container forms a hollow, perforated cylinder surrounding the warming reservoir. The cylinder has open ends respectively defining the loading and dispensing apertures which, together with the reservoir positioned between the apertures, define the staged warming pathway. A selective access mechanism is provided which permits opening and closing of the container to enable serial loading of unwarmed balls into the loading aperture, and serial dispensing of warmed balls from the dispensing aperture. The preferred warming mechanism is a disposable, non-rechargeable, chemical heating element which at least partially surrounds the warming reservoir. The heating element includes a tubular, disposable heat pack housing an air-activatable, chemical heating composite. The heat pack is secured by quick release tabs so as to be easily, removably installable around the warming reservoir. To conserve heat within the reservoir, the invention optionally provides a detachable insulation pad or sleeve surrounding the heating element.

Also in a preferred embodiment, the invention provides a mechanism for orienting unidirectional passage of balls through the staged warming pathway. Preferably, the orienting mechanism includes a one-way valve within the warming pathway which orients unidirectional passage of balls through the pathway toward the dispensing aperture.

DETAILED DESCRIPTION OF THE PREFERRED EMBODIMENTS

Figure 1:
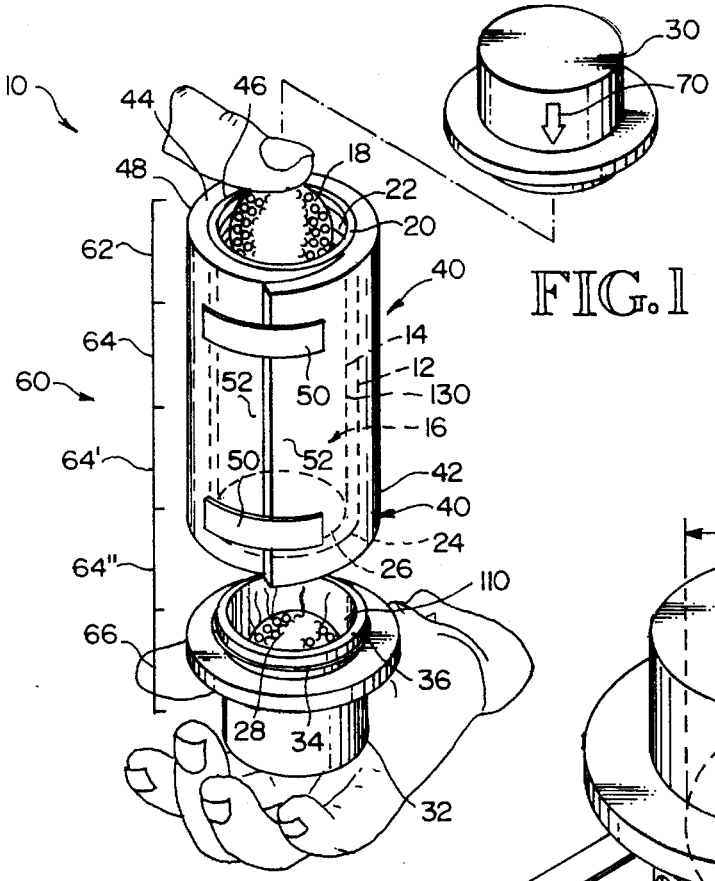
FIG. 1 is an environmental view showing a golf ball warming device employing the concepts of the present invention.

A portable, self-contained golf ball warming device employing the principles of the present invention is generally indicated at reference numeral 10 in FIG. 1. The device includes a hollow, cylindrical container 12 having a perforated sidewall 14 surrounding a ball warming reservoir 16 which is designed to receive a plurality of unwarmed, standard sized golf balls 18. The container has an open top end 20 defining a ball loading aperture 22 through which the unwarmed balls can be loaded into the warming reservoir 16. Opposite the loading aperture, a bottom end 24 of the container defines a second, dispensing aperture 26 through which warmed balls 28 can be dispensed from the reservoir after they have been warmed to a high performance temperature. In addition, the container optionally includes a selective access mechanism in the form of a top cap 30 adapted to securely close the loading aperture, and a bottom cap 32 adapted to securely close the dispensing aperture. The caps function to insulate the reservoir against heat loss and to contain the golf balls loaded therein. Preferably, the caps have a fast mounting and removal mechanism, such as an o-ring 34 seated in a female flange 36 of the cap for compressibly mating the flange with the container apertures 22, 26, to allow rapid access to the reservoir.

Figure 2:
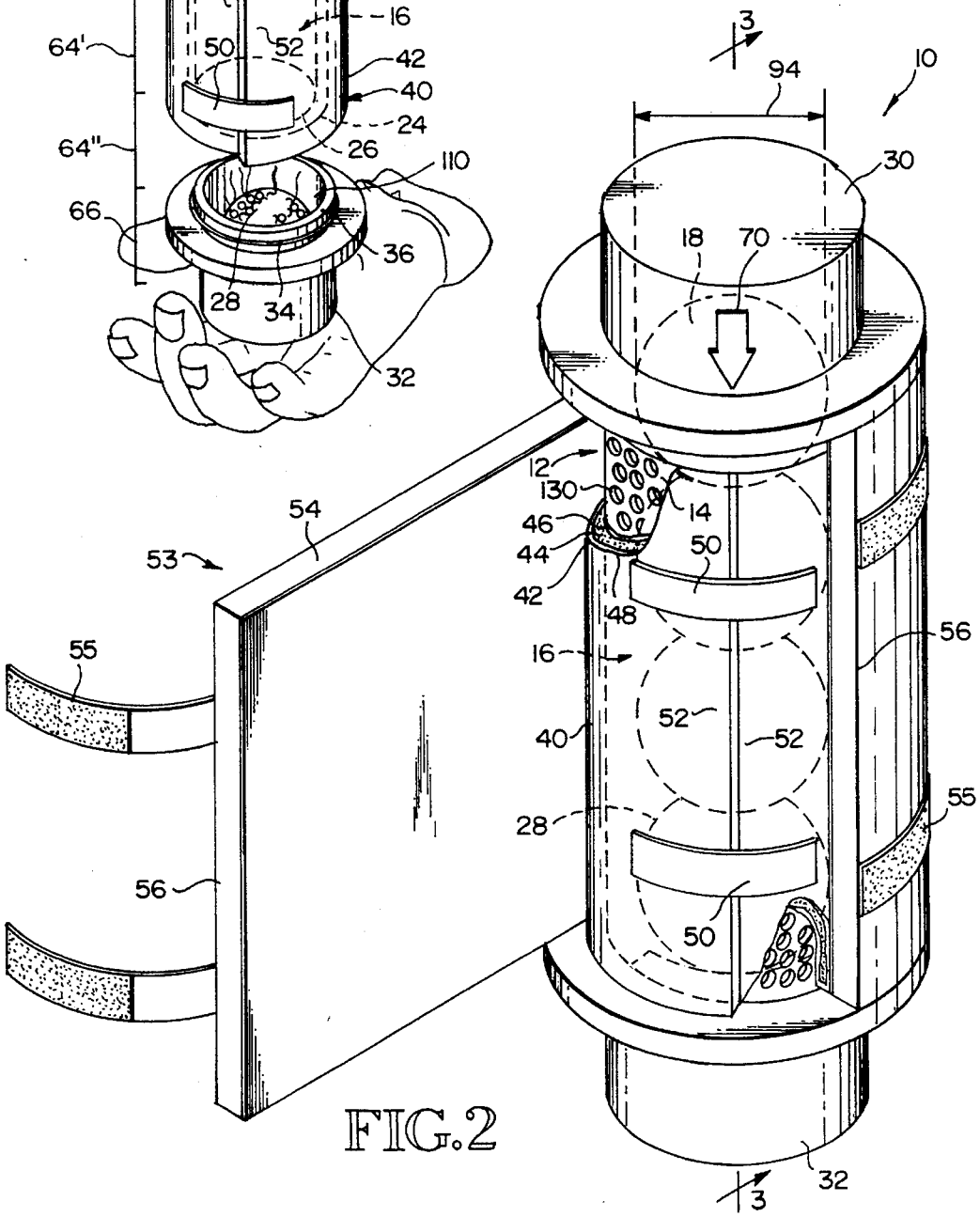
FIG. 2 is an enlarged, isometric view of the warming device showing a partially detached insulating pad surrounding a mounted heat pack having cut-away portions to show the underlying, perforated sidewall of the container surrounding the warming reservoir.

To warm the golf balls 18 contained in the reservoir 16, the invention provides a fully self-contained, disposable, non-rechargeable warming element, or chemical heat pack 40, surrounding the reservoir 16 for generating and transmitting heat to the reservoir, illustrated in FIG. 2. Preferably, the heat pack includes a bilayered cloth pad 42 containing an air-activatable, chemical heating composite 44 sandwiched between an interior sidewall 46 and an exterior sidewall 48 of the pad. The heat pack is rolled into a tubular shape and is dimensioned to fit closely around the container sidewall 14 surrounding the reservoir 16. The pack is removably installable around the container using complementary, quick release adhesive or Velcro® tabs 50 connected to opposing free ends 52 of the pack, to facilitate removal and replacement of the pack.

Figure 3:
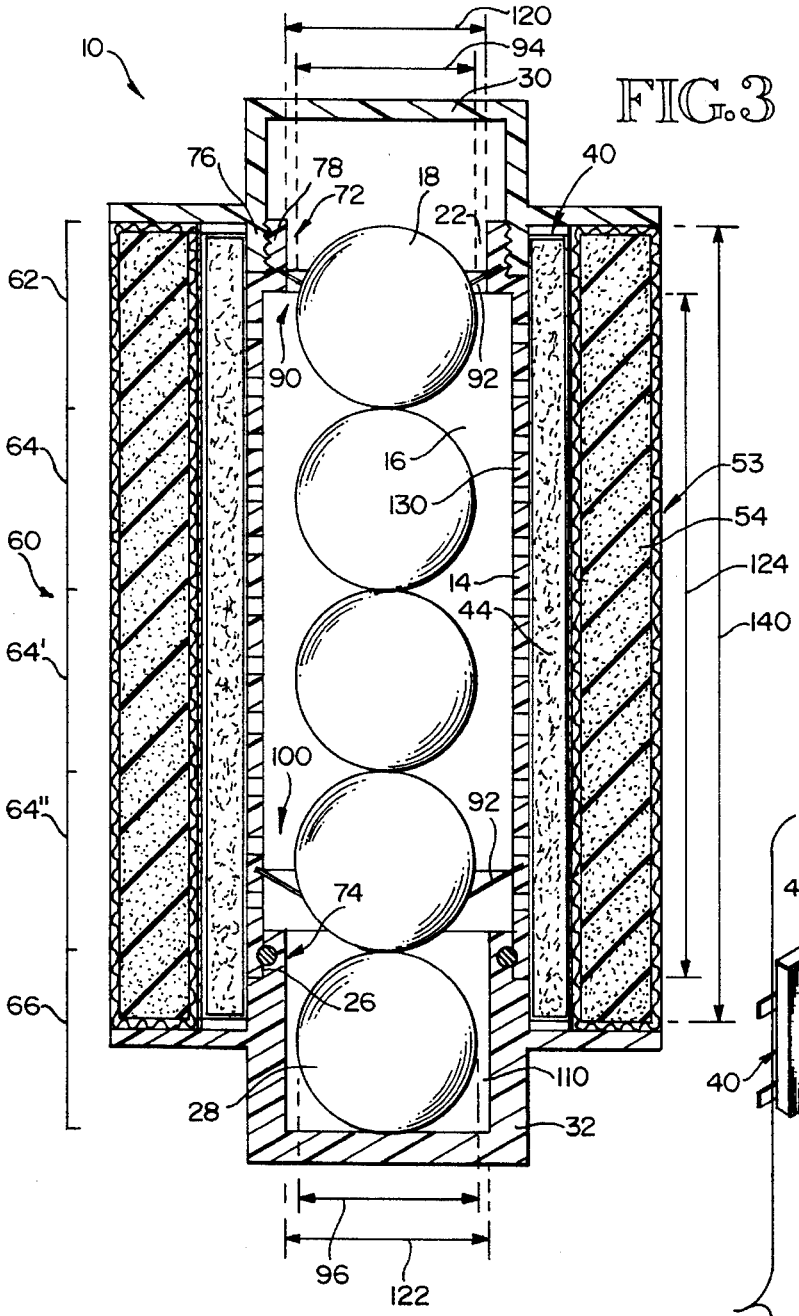
FIG. 3 is a sectional view of the warming device taken along lines 2—2 of FIG. 2.
Figure 4:
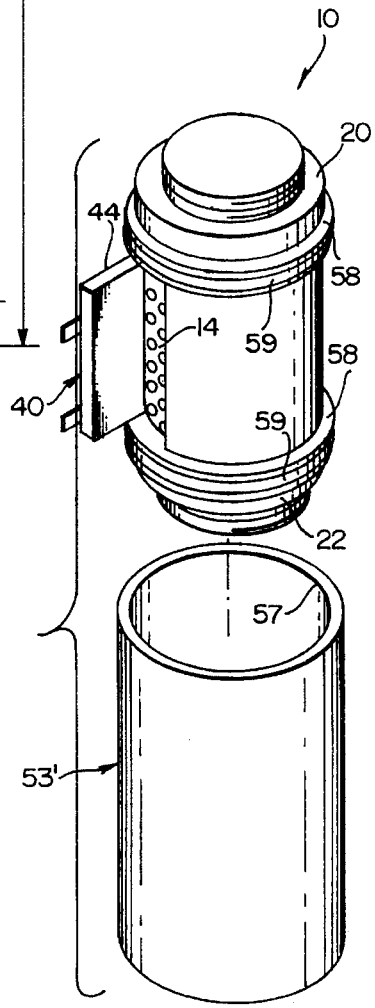
FIG. 4 is an exploded isometric view of a warming device of the invention having a slide-on, outer insulating sleeve.

To conserve warmth from the heat pack 40 and insulate the reservoir 16, the invention further provides a removably installable, insulating sleeve 53 surrounding the heat pack. Referring to FIGS. 2 and 3, the preferred insulating sleeve is a thermal textile or foam pad 54 which can be rolled into a tubular shape and is dimensioned to fit closely around the heat pack after the pack has been installed. The insulating pad is also removably installable using complementary, quick release adhesive or Velcro® tabs 55 connected to opposing free ends 56 of the pad. In an alternate insulating design, illustrated in FIG. 4, the insulating sleeve 53' forms a rigid tube 57 adapted to quickly mount to sealably enclose the container sidewall 14. The tube mounts by sliding the tube over two, O-ring fitted mounting flanges 58 near the container ends 20, 24, so that the tube forms a snug, friction fit over compressible O-rings 59 extending peripherally around the flanges. Both insulating sleeve arrangements offer the advantages of easy removability of the sleeve to allow quick replacement of the heat pack 40 between uses.

Referring to FIGS. 1–3, the overall design of the golf ball warming device 10 is specially adapted to provide a continuous supply of warmed golf balls 28 throughout an extended round of cold weather golf play. To accomplish this, the device provides a novel construction of the container 12 which includes two access points into the reservoir 16; the loading aperture 22 for loading unwarmed balls 18 into the reservoir, and the separate, dispensing aperture 26 for dispensing warmed balls 28 from the reservoir. By virtue of this dual aperture design, operation of the invention is far more flexible than prior art, single aperture designs, which effectively prohibit re-loading of balls into the device after a round of golf play begins. In contrast, the dual aperture design of the invention permits continuous, serial loading of unwarmed balls 18 at one end 20 of the container, and simultaneous, serial dispensing of warmed balls 28 at the opposite end 24. This allows for continuous warming and re-warming of golf balls in a staged warming cycle, which can be repeated over and over as an extended round of golf play continues using a small, recyclable playing stock of balls.

As illustrated in FIG. 3, staged, cyclic warming of golf balls 18 is an inherent attribute of the dual aperture design of the invention, which provides a staged heating pathway 60 defined by the loading aperture 22, reservoir 16 and dispensing aperture 26 collectively. In a first staging position 62 of the pathway, an unwarmed ball 18 is introduced through the loading aperture into the reservoir. In intermediate staging positions of the pathway 64, 64' 64", the unwarmed ball resides in the reservoir for a period of time until the ball is warmed by heat transmitted to the reservoir from the heat pack 40 to a high performance temperature of about 90° F. to 120° F. In a final staging position 66, the warmed ball 28 is dispensed from the dispensing aperture 26 for play, at which time the ball begins to cool and may subsequently be recycled back through the heating pathway.

The golf ball warming device 10 functions optimally when the reservoir 16 is loaded to capacity with a maximum number of golf balls, as shown in FIGS. 2 and 3, so that all of the intermediate staging positions 64, 64', 64"0 of the heating pathway 60 are occupied by balls in sequential stages of warming. When the reservoir is thus loaded to capacity, introduction of an additional unwarmed ball 18 into the first staging position 62 automatically displaces balls occupying the intermediate positions, so that a fully warmed ball 28 occupying a last intermediate position 64" automatically advances into the final staging position 66 for retrieval and use in play.

To orient serial, staged passage of golf balls 18 into and through the staged warming pathway 60, the invention provides a unidirectional orienting mechanism, or external marker 70, shown in FIGS. 1 and 2, to signal to the user which end 20, 24 of the container 12 should be opened to access the loading aperture 22 or dispensing aperture 26. Alternatively, as shown in FIG. 3, proper orientation for loading and dispensing balls may be conveyed by tactile differences in the operation of closing mechanisms 72, 74 with which the top cap 30 and bottom cap 32 are mounted to the container. For example, the bottom cap may be equipped with the quick mounting, o-ring 32 and female flange 36 design, described above, to allow rapid dispensing of balls. The top cap may then be provided with a threaded female flange 76 to mate with a threaded male flange 78 surrounding the loading aperture 22, to enable the user to tactually distinguish between the two ends of the container.

In addition to these simple, external orientation mechanisms 70, 72, 74, the invention also provides a unidirectional flow regulating mechanism, or one-way loading valve 90, which functions to regulate, as well as orient, serial, staged loading and passage of golf balls 18 into and through the staged warming pathway 60. As shown in FIG. 3, the valve includes one or more opposing spring-steel tabs 92 embedded in the sidewall 14 of the container 12 surrounding the loading aperture 22 and depending downward toward the reservoir 16. The tabs partially occlude the loading aperture and are spaced apart so that a clearing distance 94 between opposing tabs is less than a standard golf ball diameter 96 when the tabs are undepressed. Consequently, to admit an unwarmed golf ball 18 into the reservoir through the loading aperture, the ball must be pushed downward against the tabs with sufficient force to depress the tabs, thereby increasing the clearing distance to permit the ball to pass between the tabs. Thereafter, the ball cannot pass back out of the reservoir through the loading aperture because the one-way, downward depending tabs block upward passage of the ball.

To further orient and regulate serial, staged passage of golf balls 18 into and through the staged warming pathway 60, the invention also provides a one-way dispensing valve 100, also shown in FIG. 3. The dispensing valve also includes opposing spring-steel tabs 92, but they are embedded in the sidewall 14 of the container 12 surrounding the reservoir 16 depending downward toward the dispensing aperture 26. The tabs partially occlude the dispensing aperture and are similarly spaced as the tabs of the loading valve, so as to regulate unidirectional flow of golf balls out of the reservoir through the dispensing aperture.

In conjunction with the dual aperture design of the invention, the loading valve 90 and dispensing valve 100 facilitate continuous, serial loading of unwarmed balls 18 at one end 20 of the container, and simultaneous, serial dispensing of warmed balls 28 at the opposite end 24, as illustrated in FIG. 1. When an unwarmed ball is introduced through the loading aperture into the reservoir, and the reservoir is filled to capacity so that all of the intermediate staging positions of the pathway 64, 64', 64" are occupied, the introduction of an additional unwarmed ball 18 into the first staging position 62 automatically displaces balls occupying the intermediate positions, so that a fully warmed ball 28 occupying the last intermediate position 64" passes through the dispensing valve 100 and advances into the final staging position 66 for retrieval and use in play. Ball retrieval at the final staging position is facilitated by providing the bottom cap 32 with a receiving well 110 deep enough to allow the ball to drop through the dispensing aperture into the well while the bottom cap is still mounted to the container 12. As shown in FIG. 1, this allows the user to simply advance a warmed ball to the final staging position into the receiving well of the cap, and then pop the bottom cap off with the warmed ball securely contained in the receiving well, thereby preventing fumbling or dropping of the ball.

In further detailed aspects of the invention, the preferred, cylindrical container 12, illustrated in FIGS. 1–3, is specifically adapted to receive a capacity load of three, and preferably 4, standard golf balls having a standard ball diameter 94 of about 42 mm. Accordingly, a minimum aperture diameter 120 and a minimum reservoir diameter 122 of the container must be about 45 mm each, to permit smooth passage of golf balls through the apertures 22, 26 and reservoir 16. In addition, a minimum reservoir length 124 should be about 135 mm–180 mm to accommodate the preferred capacity load of balls. Manufacture of the container and end caps 30, 32 can be accomplished using a variety of materials and methods of manufacture. Preferably, the container and end caps are formed of a rigid material, such as a metal or plastic. Polyvinyl plastics, such as polyvinyl chloride (PVC) and related plastics are particularly preferred, because such materials are inexpensive and widely available, and because standard PVC plumbing fittings can be obtained as pre-fabricated parts to make the container and caps. A preferred method of manufacture of the container and caps is conventional injection molding, however extrusion molding and other conventional fabrication and milling processes are also suitable.

An important design feature of the container is the perforated sidewall 14 surrounding the reservoir, which has a number of regularly spaced perforations 130 spanning the sidewall to allow air flow and heat transfer between the heat pack 40 and the reservoir 16. In heavily insulated embodiments of the invention, such as the designs shown in FIGS. 3 and 4, the sidewall perforations may also be important to increase oxygen transfer from the reservoir to the heat pack, to feed oxygen dependent chemical reactivity of the chemical heating composite 44.

The chemical heating composite 44 itself is an air-activatable, non-combustive, non-liquid fueled composite of organic, non-toxic, non-caustic exothermically co-reactive materials, preferably including iron powder, water, salt, activated charcoal and wood pulp. These materials, or other substitutable materials known in the art, are mixed in a well known composition and stoichiometry to yield an exothermic chemical reaction of the composite upon exposure of the composite to air. Accordingly, before a heat pack 40 is installed for use in the ball warming device 10, it must be stored in air tight packaging (not shown), so as to keep the heating composite inactive until use. A variety of commercially available heat packs are made which incorporate the preferred heating composite, and which have acceptable dimensions for use in the invention. Referring to FIG. 3, the preferred heat pack has a length 140 closely similar to the reservoir height 124, and a minimum length (not shown) to completely embrace a circumference (not shown) of the container sidewall 14.

Figure 5:
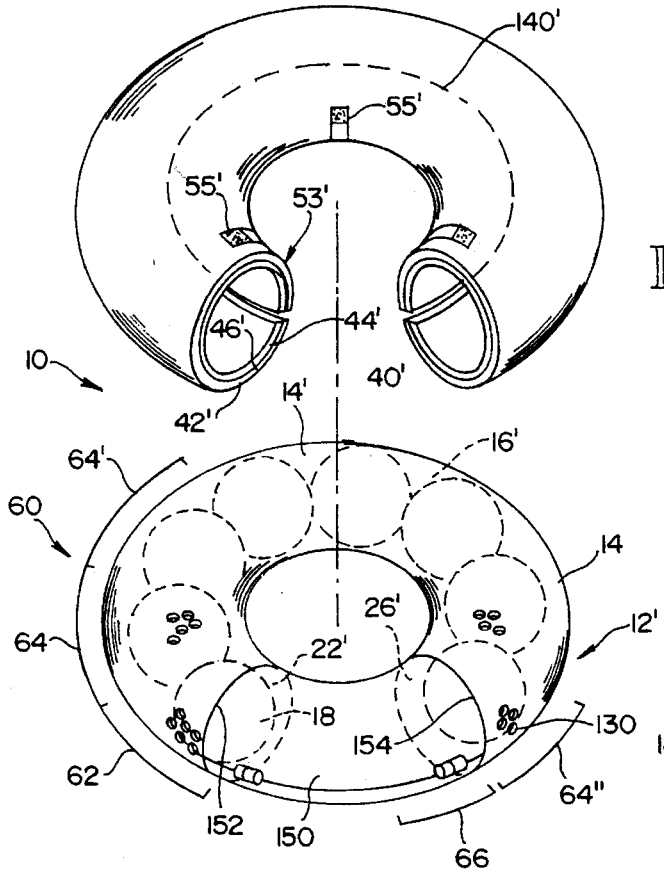
FIG. 5 is an exploded isometric view showing an alternative embodiment of the invention having a toroidal container and complementary shaped, detachable warming pack.

Returning to the broader aspects of the invention, FIG. 5 shows an alternative embodiment 10' of the golf ball warming device, which differs in some basic design features from the above described embodiments. A primary difference is that the embodiment of FIG. 5 has a toroidal rather than a cylindrical container sidewall 14' and reservoir 16' and, instead of end caps 30, 32 to close and open individual ends of the container, has a securely closeable, hinged access door 150 for selectively accessing both an internal ball loading aperture 22' and internal ball dispensing aperture 26'. In addition, this embodiment of the invention uses a semi-toroidal, removable heat pack 40' and insulating sleeve 53' dimensioned to fit around the container and the reservoir, between left and right ends of 152, 154 of the access door.

Figure 6:
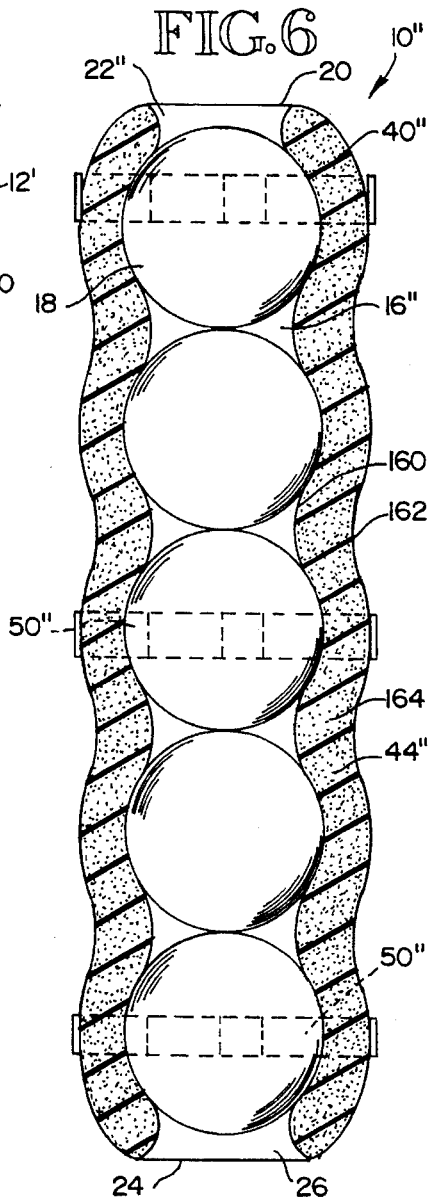
FIG. 6 is an enlarged, cut-away view of part of the container shown in FIG. 5, detailing the access door and loading aperture of the container.

To use the toroidal embodiment 10' of the invention, it is preferable to pre-load the reservoir 16' with a full capacity load of golf balls by opening the access door 150, as shown in FIG. 6, and inserting unwarmed balls 18 one at a time through the one-way loading valve 90' positioned near the loading aperture 22', until a ball in the last intermediate staging position 64" forcibly abuts the dispensing valve (not shown) without causing the valve to open. When the reservoir is thus loaded to capacity, the balls can be pre-heated, preferably for a period of 1–5 hours before play begins. Subsequently, as play continues, additional unwarmed balls 18 can be serially introduced into the first staging position 62, automatically displacing balls in the intermediate positions 64, 64', 64", so that a fully warmed ball 28 occupying the last intermediate position 64" automatically advances clockwise into the final staging position 66 so as to be immediately accessible for play upon opening the access door 150.

Figure 7:
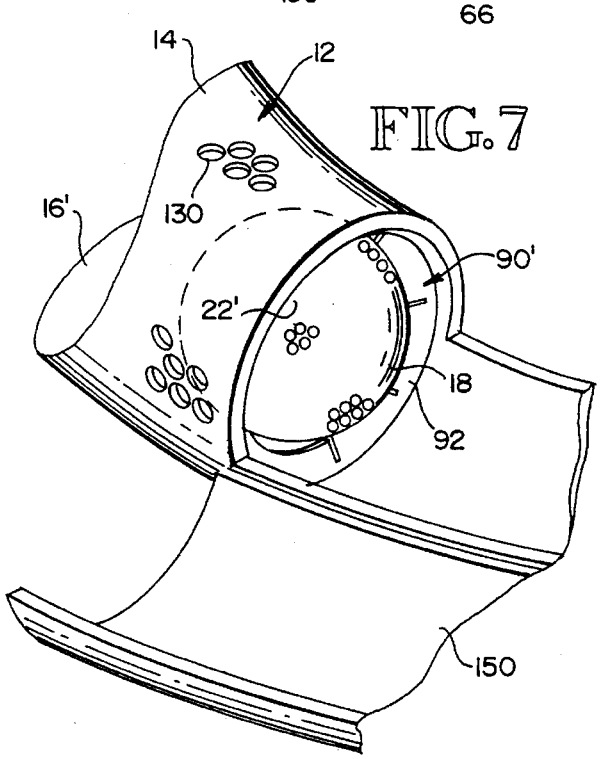
FIG. 7 is a sectional view of a simplified embodiment of the invention, wherein the warming device includes a tubular heat pack having deformable sidewalls and a layer of chemical heating composite sandwiched between the sidewalls.

In a highly simplified embodiment 10" of the invention, illustrated in FIG. 7, the warming device 10" consists of a modified, tubular heat pack 40" sized and dimensioned to securely enfold a number of golf balls 18 to be warmed in a central warming reservoir 16". The pack has interior 160 and exterior 162 sidewalls sandwiching a middle layer 164 filled with the chemical heating composite 44". The pack can be in the form of a circumferentially continuous tube (not shown) or, alternatively can be rolled and secured into a tube shape (as shown in FIG. 7) from a conventional, flat, pad shape (not shown) using complementary, quick release adhesive or Velcro® tabs 50' connecting opposing free ends (not shown) of the pack. To load and dispense golf balls from the reservoir, top and bottom ends 20", 24" of the pack are open, so as to define loading 22" and dispensing apertures 26". The sidewalls 160, 162 of the pack are deformable, and the heating composite partially resists deformation of the walls in the manner of sand in a sand bag. Consequently, balls loaded through the loading aperture into the reservoir are held snugly against the deformed interior sidewall, but can be forcibly, serially displaced toward the dispensing aperture by inserting another ball into the loading aperture, whereby the device functions to stagedly warm and re-warm a stock of balls for sequential use in play.

Those with ordinary skill in the art will appreciate that other embodiments and variations of the invention are possible which employ the same inventive concepts described above. Therefore, the invention is not to be limited by the above disclosure, but is to be determined in scope by the claims which follow.

What is claimed is:

1. A portable golf ball warming device, comprising:

a hollow, cylindrical container for housing a plurality of golf balls to be warmed, the container having first and second ends, the first end defining a ball loading aperture and the second end defining a ball dispensing aperture separate from the loading aperture;

a ball warming reservoir located between the ends, wherein the loading aperture; warming reservoir and dispensing aperture collectively define a staged warming pathway for stagedly warming the balls;

self-contained warming means proximate the ball warming reservoir for warming the balls;

selective access means for opening and closing the container and accessing the apertures to serially load unwarmed balls into the loading aperture and serially dispense warmed balls from the dispensing aperture, whereby the balls can be stagedly warmed and re-warmed by serial passage of the balls through the staged warming pathway during a round of golf play; and unidirectional orienting means for orienting unidirectional, serial passage of balls through the staged warming pathway, wherein the orienting means includes a one-way valve within the staged warming pathway to restrict bidirectional passage of balls therethrough.

2. A portable golf ball warming device for warming golf balls having a standard ball diameter, comprising:

a hollow, toroidal container for housing a plurality of golf balls to be warmed, the container having an interior sidewall and an exterior sidewall, the interior sidewall defining a ball loading aperture and a ball dispensing aperture separate from the loading aperture:

a ball warming reservoir between the apertures for receiving a plurality of golf balls, wherein the loading aperture, warming reservoir and dispensing aperture collectively define a staged warming pathway for stagedly warming the balls; and self-contained warming means intermediate the interior and exterior sidewalls and substantially surrounding the reservoir for warming the balls, whereby the golf balls can be stagedly warmed by serial passage of the balls through the staged warming pathway during a round of golf play.

3. A portable golf ball warming device for warming golf balls having a standard ball diameter, comprising:

a hollow container for housing a plurality of golf balls to be warmed, the container having an interior sidewall and an exterior sidewall, the interior sidewall defining a ball loading aperture and a ball dispensing aperture separate from the loading aperture;

a ball warming reservoir between the apertures for receiving a plurality of golf balls, wherein the loading aperture, warming reservoir and dispensing aperture collectively define a staged warming pathway for stagedly warming the balls;

self-contained warming means intermediate the interior and exterior sidewalls and substantially surrounding the reservoir for warming the balls, whereby the golf balls can be stagedly warmed by serial passage of the balls through the staged warming pathway during a round of golf play; and unidirectional orienting means for orienting unidirectional, serial passage of balls through the staged warming pathway, wherein the orienting means includes a one-way valve within the staged warming pathway to restrict bidirectional passage of balls therethrough.

* * * * *